United States Patent [19]

Creissels

[11] Patent Number: 4,509,430

[45] Date of Patent: Apr. 9, 1985

[54] TWIN SUSPENSION/HAULAGE CABLE GONDOLA LIFT

[76] Inventor: Denis C. Creissels, 43, Boulevard des Alpes, 38240 Meylan, France

[21] Appl. No.: 501,138

[22] Filed: Jun. 6, 1983

[51] Int. Cl.[3] ..... B61B 9/00

[52] U.S. Cl. ..... 104/173 R; 104/112; 104/180; 104/196

[58] Field of Search ..... 104/173 R, 173 ST, 112, 104/180, 196, 89

[56] References Cited

U.S. PATENT DOCUMENTS 1,719,758 7/1929 Dutkiewicz ..... 104/180
3,588,049 6/1971 Nectoux ..... 104/173 R
4,370,932 2/1983 Etcheparre et al. ..... 104/173 R

FOREIGN PATENT DOCUMENTS 1249949 11/1960 France .
1453517 4/1966 France .
410730 10/1963 Switzerland ..... 104/173 R

*Primary Examiner*—Robert R. Song
*Attorney, Agent, or Firm*—Parkhurst & Oliff

[57] ABSTRACT

The invention relates to a continuous operation gondola lift with twin parallel suspension/haulage cables between which the gondolas hang, connected to the cables by means of detachable grips. Inside the terminals the gondolas are disconnected from the cables and travel on transfer rails at reduced speed.

14 Claims, 27 Drawing Figures

TWIN SUSPENSION/HAULAGE CABLE GONDOLA LIFT

Background and Summary of the Invention

The invention concerns an overhead cable transport installation, namely a lift with gondolas coupled in line to two parallel continuous motion suspension/haulage cables, by means of suspension bars hanging in the vertical symmetry plane of the two cables, and articulated on a carriage bearing at least one pair of detachable grips intended for connecting the carriage to both cables, in line, and disconnecting the gondolas in the terminals, by detachment of the grips, to allow for passenger embarkation and disembarkation, at null or reduced speed.

Gondola lifts of the type mentioned offer numerous advantages, particularly of simplicity, high capacity and ease of embarkation and disembarkation for the passengers.

The suspension is situated in the vertical symmetry plane of the two cables, and the fact that the gondolas rest on two cables instead of one provides them with a great lateral stability, as the side stresses, mainly wind, are transmitted to both cables.

A gondola of a known type (FR-A-1.249.949) has grips which clamp the cable from underneath, and the grip jaws fulfil the double function of supporting the gondola's weight and of locking it on the cable. The reliability of such grips is not absolute, as the weight tends to open the jaws. The grip dimensions, especially their protruding above and below the cable, prevent them from passing over the support rollers and under the pressure rollers, and it is therefore necessary to install guides that push the cable away from the rollers while the grip is passing over them, which is practically not possible in huge installations with high cable tension.

The purpose of this invention is to cope with these difficulties, and to allow a construction of twin suspension/haulage cable installations that would preserve the same advantages of simplicity as those of the single cable gondola lifts.

The installation according to the invention is characterized by the fact that every grip is made of a body that rests in coupled position on the upper face of the cable, slightly protruding upwards, and further of a pair of jaws protruding downwards from the body and enveloping the cable on both sides, the jaw ends coming level with or slightly lower than the lower face of the cable, with a view to facilitating the passing over or under the cable support rollers, and in such a manner that, inside the terminals, guide rollers push the cables away from each other so as to increase the clearance between them and allow for the disengagement of the carriage disconnected from the cables.

Still using conventional grips resting on the upper face of the cable, the difficulties occasioned by the passing over the rollers are solved, as well as operation safety problems, but the carriage still remains engaged between the cables, even after the jaws have been opened in the terminals. According to the invention, guide rollers increase the clearance between the cables in order to allow for the disengagement of the carriage and its travelling on to transfer rails independent of the cable lines.

The clearance between the cables results from a compromise between the need for maintaining the support structures' dimensions inside acceptable and controllable limits, and the necessity of maintaining between the cables enough space for the horizontal guiding rollers in the terminals, and for ensuring lateral stability. The optimal clearance is comprised between 25 and 100 cm, as near as possible to 75 cm. The cable diameter is comprised between 0.035 and 0.050 m, preferably about 0.042 m.

To derive the maximum benefit from the lateral stability provided by the twin support of the carriage, the gondola is fixed to the carriage by means of its suspension bar with only one possibility of motion, i.e. oscillating inside the vertical symmetry plane.

According to an improvement of the invention, the carriage bears two pairs of detachable grips; this means two grips for each cable, and these grips can be staggered with respect to each other in the direction of the carriage movement, or be set two by two in front of each other with a certain overlapping, for instance a coaxial lay-out of the springs. Both of the grips coupled to one cable are symmetrically placed on both sides of the cross symmetry axis of the carriage, which passes through the coupling points on the cables. The control of the opening and closing of the grips on entering or leaving the terminals may be common to all grips of one carriage, but it is however preferable, for reasons of safety and standardization, to provide for an individual control lever for every grip, that comes in contact with a rail or a fixed cam, in the usual manner, at the connecting and disconnecting points of the carriages. The control is then symmetrical with respect to the vertical symmetry plane of the cables, so as to prevent the action on the levers from throwing the carriage out of balance. A different control device may be envisaged. Every grip is then installed on the carriage on a rubber cushion allowing for a slight rotation of the grip with respect to the other one on the same cable, and of both grips on one cable with respect to the grips on the other cable, in order to prevent any warping of the carriage.

The four grips form a rigid junction quadrilateral between both cables, which of course move in phase. All of them have the same height symmetrically, and consequently they pass under parallel roller sets without generating dissymmetrical stresses that could put the carriage out of shape, or warp it. In the same way, the driving or braking devices at the entrance or exit of the terminals, or inside them, are always double and symmetrical.

According to an important feature of the invention, both cable lines offer a perfectly symmetrical friction, which means that the frictional resistances are identical for both cables, as a result of symmetrical trajectories and/or of braking devices applied to one of the cables.

In the drive terminal, each cable passes over an end pulley, both pulleys being identical and superposed. Both pulleys are driven through a differential device which applies the same pull to both cables. The differential may be mechanical, hydraulic or electric. The combined action of the differential, of the equality of the frictions and of the junction between both cables realized by the rigid quadrilaterals formed by the carriage grips, results in a synchronous movement preventing any staggering or slanting of the gondolas. Obviously, similar precautions are essential concerning the braking down of the pulleys, and, according to an additional development of the invention, the braking device interlocks both pulleys mandatorily. A very simple means consists of inserting the rims of both coaxial pulleys, which are very close to each other, between the jaws of the brake clamp, and the jaws will push the rims against each other when applying the brake. The use of a single brake clamp ensures an even distribution of the braking effort, and also a friction coupling of both pulleys, preventing any shifting. A brake lining with a certain elasticity can be adjusted to the outer circumference of each pulley.

Regarding the differential, it can be advantageously designed as an electrically working device, based on strictly identical outputs of both driving motors. In case of such a construction, the stresses to overcome are the same on both cable lines, the cable motion speed is the same, whatever the compared diameters of both drive pulleys, since the compared output is the product of the effort by the motion speed.

To achieve such an electric differential, provision must be made for a direct current supply source common to both motors with identical electric characteristics.

When both cable lines have equal efforts to overcome in line, if the mechanical efficiency of the machines is equal and if the motors are identical, the current voltages and intensities will be the same in each of both supply circuits of the motors, when the latter will be connected to the same direct current supply, and they will deliver the same output.

If on the other hand an exterior factor changes, particularly when the efforts to overcome in line are not equal, the motors will work in a dissymmetrical manner, with different voltages and/or intensities.

One of the essential advantages of this electric differential is that it reports any operation difference between the two lines—with respect to the initial state which may be slightly dissymmetrical.

Dials with different triggering points for control functions make it possible to know at any time the state of one of the lines with respect to the other, and to stop the installation automatically in case of disadjustment beyond a predefined value. This reporting and the control sequence make up an essential safety device.

In the cable tightening terminal, each cable goes over a loose guide pulley, and both pulleys are mounted on a mechanical, hydraulic or electric compensation bar that balances the tension in both of them. The pulleys can advantageously be staggered laterally with respect to the direction of the cables, by a distance corresponding to the clearance between the cables inside the terminal. The length distance between both pulleys offsets slight length differences between both cable lines.

In the terminals, the carriages are disconnected from the cables, and taken over by transfer rails running along the embarkation and disembarkation platforms. The carriages have four wheels rolling on the rails, and are driven either by gravity, or by a drive mechanism, for instance a chain with lugs. The wheels are mounted in pairs, in front of each other, and travel on two parallel rails in the straight sections. In the curves, there is only one rail left, on the inside of the curve, which facilitates shunting.

According to a prefered alternative of the invention, the carriage is put in between the two cables, the grips protruding outwards on both sides. After the opening of the grips and disconnection from the cables by an upward move of the carriage with respect to the cables, the latter are pushed away from each other in order to free a passage for the grips and to disengage the carriage downwards. The disengagement occurs on entering the terminal, when the carriage passes over to a clearing section. A symmetrical system at the terminal exit provides for re-engaging of the carriages on the cables.

The capacity of the gondolas, namely 12 up to 30 passengers, makes it possible to reduce the number of gondolas in service, and it is interesting to park the gondolas, or at least a sufficient number of them to cope with normal traffic, on the transfer rails, the gondolas leaving only on request.

Each of the suspension/haulage cables passes at every tower over a balancing unit bearing either support rollers or pressure rollers. Both identical balancing units are perfectly symmetrical, and their main axles are strictly in front of each other. The reversed U supports of these axles are for instance centered in front of each other on the same boring machine at the works. The reversed U supports allow for free passage of the carriages between the outriggers. The short distance between the cables, of about 75 cm, ensures a sufficient stiffness with usual structures. In order to maintain a perfect symmetry of the balancing units, their elements are connected to each other by reversed U's placed at the entrance of every element, the entrance being defined with respect to the direction of the cables' motion.

The disposition of the invention which suppresses any side swinging on passing the towers allows for the use of support rollers whose inner flanges with respect to the line have a larger diameter in order to achieve a very efficient anti-derail device.

According to a realization alternative, the grips are turned towards the inside, the U-shaped carriage enveloping both cables. The overall dimensions of the carriage are larger, but the balancing unit supports are simpler and comprise only a cross bar supporting a unit at each of its ends. The disengagement of the carriage requires a squeezing of both cables.

Brief Description of the Drawings

Other advantages and features will appear clearly from the following description of the different realization alternatives of the invention, which are described as non limitative examples, and represented on the annexed drawings, among which.

Detailed Description of a Preferred Embodiment

Figure 1:
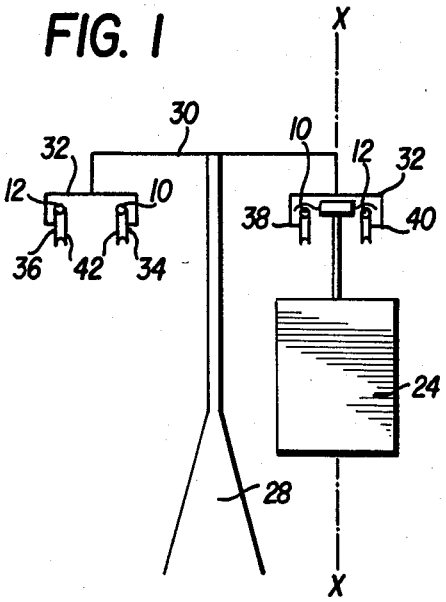
FIG. 1 is a schematic cross view of a gondola lift tower according to the invention.

The different figures represent two gondola lift suspension/haulage cables 10 and 12 running in a closed circuit between two end terminals 14 and 15 where they pass over vertical spindle 20, 21; 22, 23 end pulleys 16, 17, 18 and 19. The end pulleys 16 and 17 of terminal 14 drive the cables 10 and 12 continuously and at the same speed. The gondolas 24 are coupled on line to the cables 10 and 12, and may follow each other at close or longer intervals along the cables 10 and 12. On entering the terminals 14 and 15, the gondolas are disconnected from cables 10 and 12, and taken over on transfer rails 26 running along the embarkation and disembarkation platforms. Passengers board and leave the gondolas at null or reduced speed. At the terminal exit, the gondolas are accelerated by any appropriate means before being connected again to the cables 10 and 12 on the opposite line. This type of operation of gondola lifts is well known to specialists.

Figure 2:
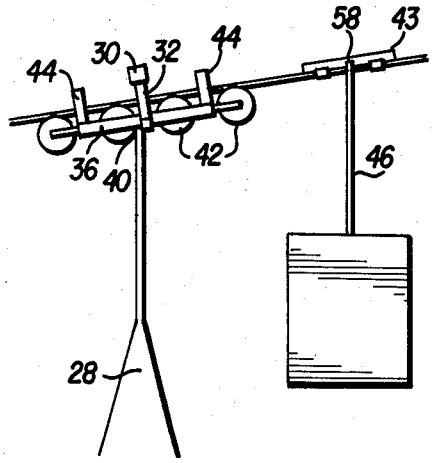
FIG. 2 is a side view of the tower according to FIG. 1.
Figure 3:
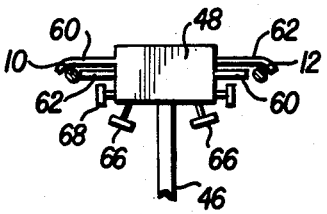
FIG. 3 is a magnified view of the carriage according to FIG. 1.
Figure 4:
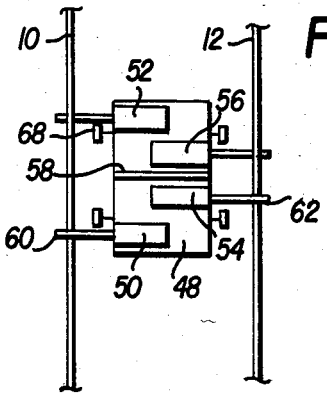
FIG. 4 is a top view of the carriage.
Figure 11:
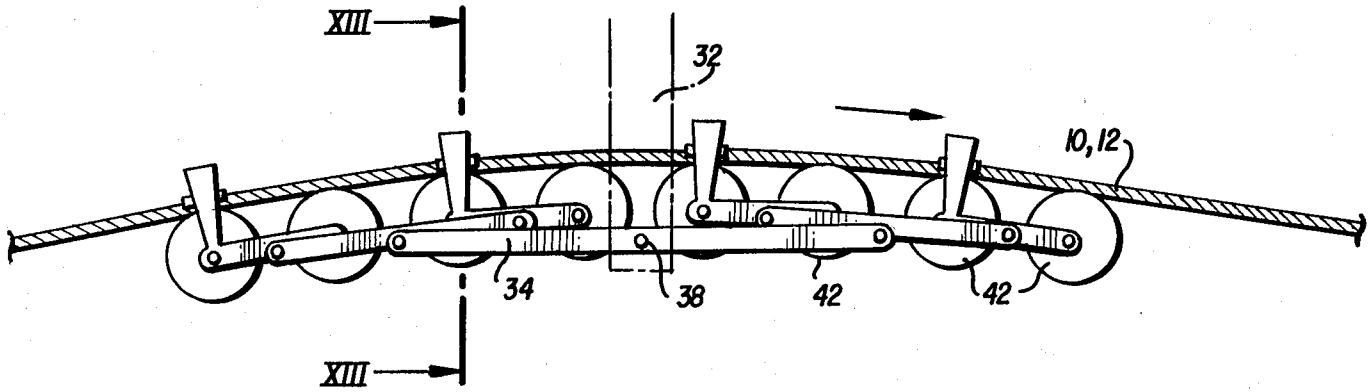
FIGS. 11 and 12 are respectively magnified front and top views of a balancing unit according to FIG. 2, with support rollers.
Figure 13:
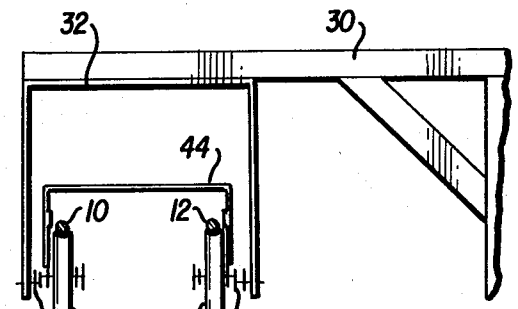
FIG. 13 is a cross-section view according to line XIII—XIII of FIG. 11.
Figure 12:
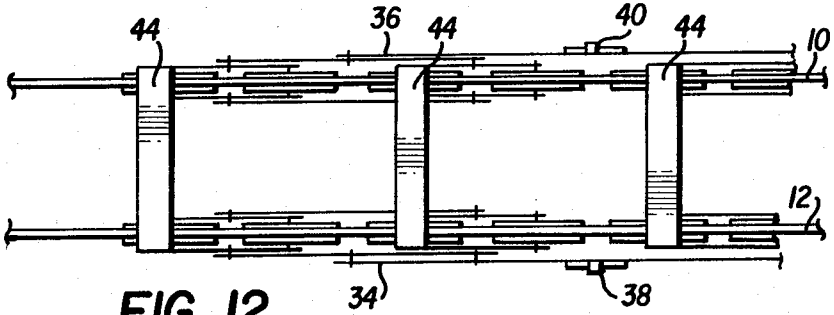

The suspension/haulage cables 10 and 12 run parallel and at the same height in line, their constant clearance from each other being comprised between 0.25 and 1.00 m, preferably about 0.75 m. Each of the cables 10 and 12 has a diameter comprised between 0.035 and 0.050 m, preferably close to 0.042 m. The cables 10 and 12 are kept up by support and guide towers 28 of identical structure, the support tower only being described hereunder in reference to FIGS. 1 and 2. At both ends of cross piece 30, a reversed U-shaped stirrup piece 32 supports the cables 10 and 12 of the up or down line respectively. At the end of each arm of the stirrup piece 32, is fixed the axle 38, 40 of the balancing unit 34, 36, which bears the support rollers 42 of the cables 10 and 12. The clearance between the balancing units 34, 36 corresponds to that of the cables 10, 12, and the whole assembly of stirrup piece 32 and balancing units 34, 36 is symmetrical with respect to the vertical symmetry plane of the cables 10, 12 indicated by the line X—X on FIG. 1. The axles 38 and 40 are perfectly in line with each other, since their supports have been centered at the works on the same boring machine. The balancing units 34, 36 move in parallel vertical planes and comprise a number of secondary balancers appropriate to the stress. To maintain the perfect symmetry of the balancing units 34, 36, it is interesting to connect the secondary, even the tertiary axles together by means of reversed U-shaped stirrups 44, which will enforce a symmetrical pivoting. On the FIGS. 11 to 13, only the last elements of the balancing unit 34, 36 are connected together by stirrups 44 mounted at the inlet side with respect to the motion direction of the cable 10 or 12. The cables 10, 12 run in the usual manner over the rollers 42 of the balancing units 34, 36, and it appears clearly that the space between the cables 10, 12 is kept entirely free for the passage of the gondolas 24. Of course, the cables 10, 12 run also under the rollers of a guide balancing unit (not shown). The inner flanges of the rollers 42 with respect to the line have a larger diameter so as to envelop the cables in a suitable manner and prevent any derailment.

Figure 5:
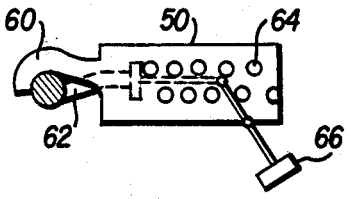
FIGS. 5 and 6 are magnified cross-section views respectively of the left and of the right grip of the carriage.
Figure 6:
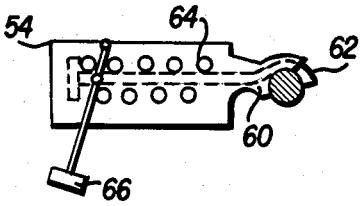
Figure 7:
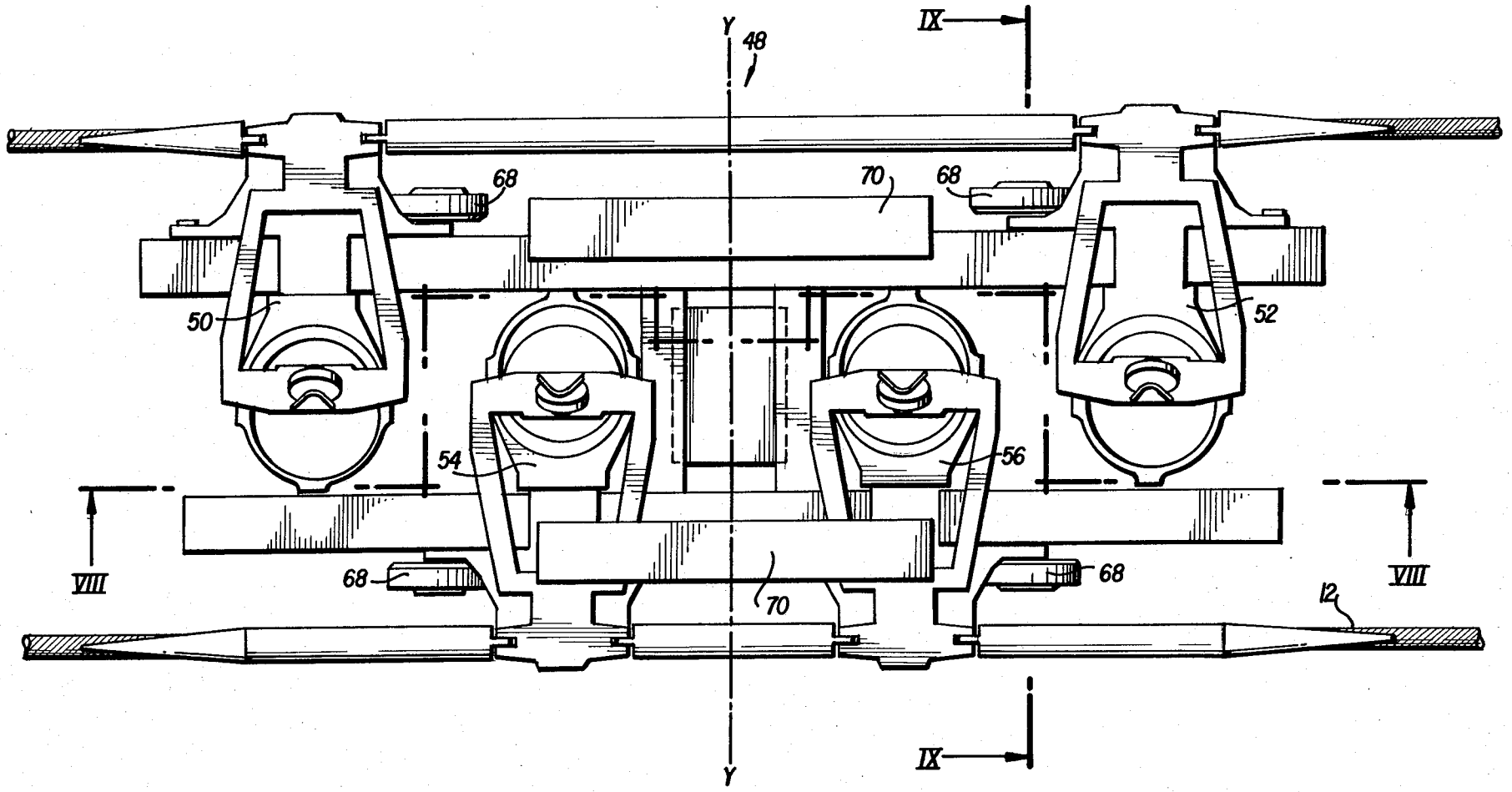
FIG. 7 is a bird's eye view of a realization alternative of the carriage.
Figure 8:
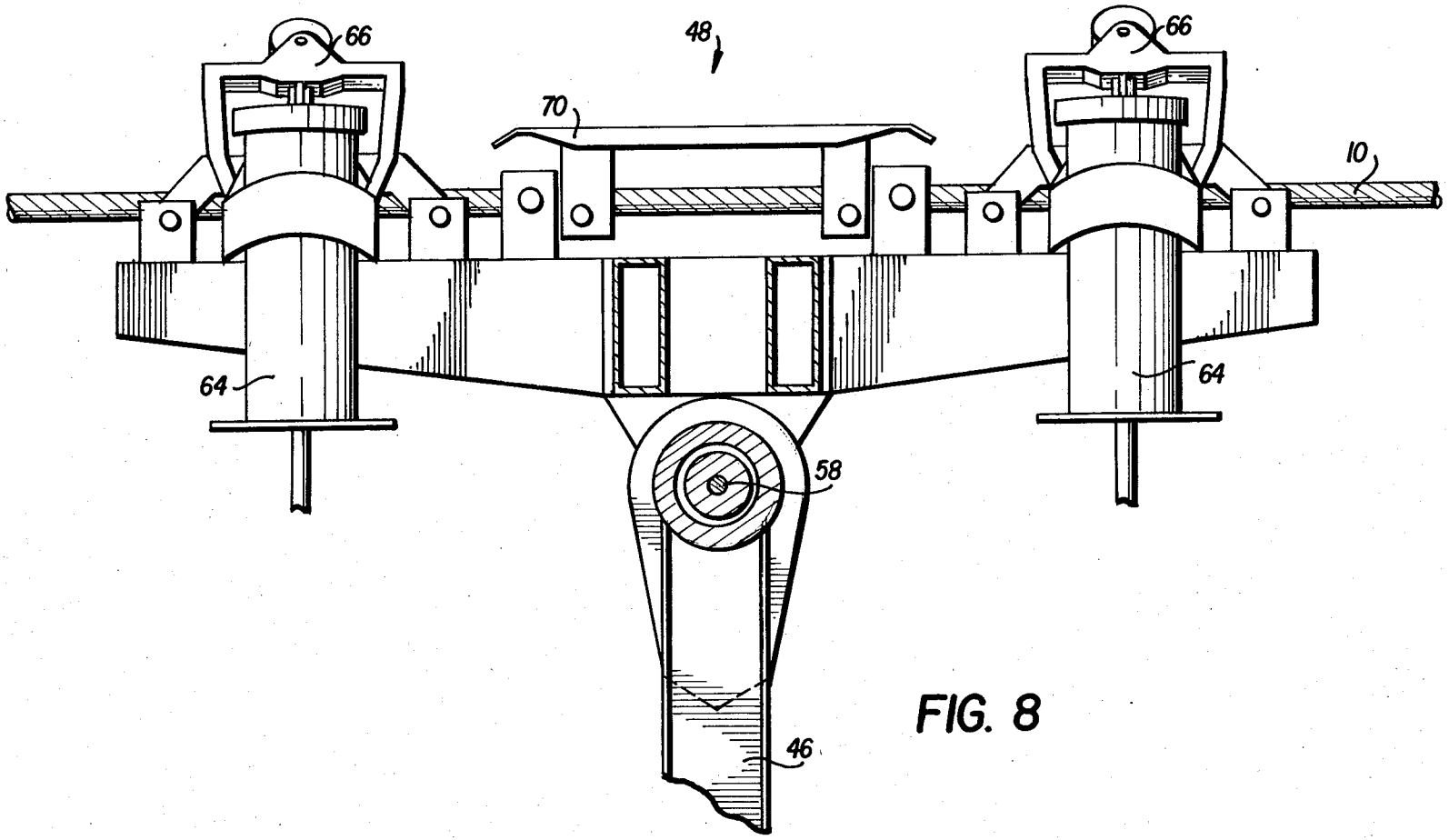
FIG. 8 is a cross-section view according to the broken line VIII—VIII of FIG. 7.
Figure 9:
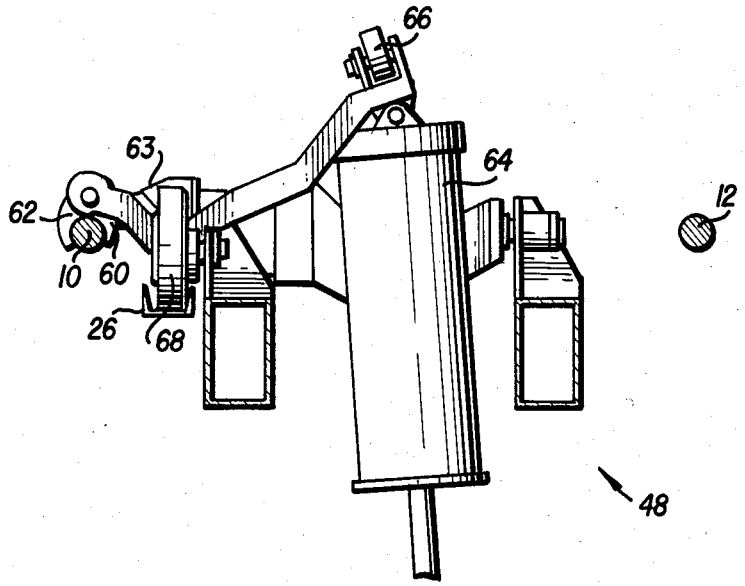
FIGS. 9 and 10 are cross-section views according to line IX—IX of FIG. 7, showing the grip in opened and closed position respectively.
Figure 10:
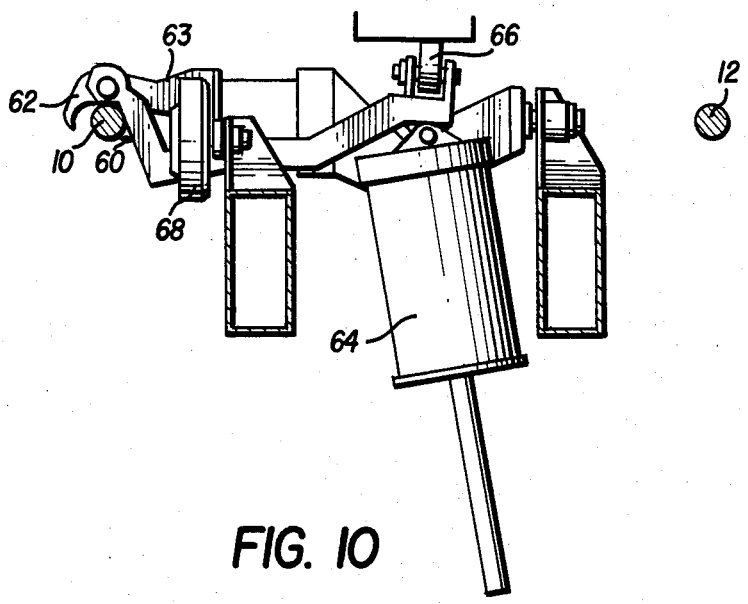

Every gondola is fitted with a suspension bar 46 whose upper end is articulated on the cross axle 58 of a carriage 48 bearing four coupling grips 50, 52, 54, 56 to the cables 10, 12. The width of the carriage body 48 is slightly smaller than the clearance between the cables 10, 12, while the jaws 60, 62 of the grips 50 to 56 protrude on both lateral sides of the carriage in order to envelop the cables 10, 12. The FIGS. 5 and 6 show schematically a grip resting on the cable with a moving jaw 62 placed respectively on the inside and on the outside. The jaws 60, 62 are held closed by the spring 64, and every grip 50 to 56 is fitted with a control lever 66 which is actioned inside the terminals by a cam or a rail running along the trajectory of the carriage 48, to open or close the grip. The grips may be of a different type, namely of one of those described below.

The grips may be staggered with respect to the carriage's length for lay-out reasons, but it is obvious that grips of a different structure may be used, and that the opposite grips 50, 54 and 52, 56 may be set level or may be overlapped. The springs may be mounted in the same axis, and certain elements, like control lever 66, may be common to several grips. The control levers 66 are placed in front of each other so that the working stresses counterbalance one another and cannot cause any transverse reaction of the carriage 48.

The shape of the jaws 60, 62 allows them to pass over and under the rollers 42 without noticeable shocks, and the height of the carriage 48's protruding over the cables 10, 12 has been reduced to a minimum in order to facilitate disengagement. Furthermore, this height is equal from one cable to the other in any plane perpendicular to the line, in order to prevent any warping of the carriage when passing under the pressure balancing units. The carriage 48 is fitted with four wheels 68 mounted in front of each other and allowing for its displacement on the rails 26 of the terminals 14. Rubber fixation blocks allow for a slight pivoting of the grips 50–56.

Another type of carriage 48 is shown in the FIGS. 7 to 10, the four grips 50, 52, 54 and 56 being of the type described in the U.S. patent application Ser. No. 334,078, filed on Dec. 24, 1981. The moving jaw 62 is supported by the control lever 66 articulated on a grip body 63 resting on the cable. The lever 66 is fitted with a control roller at the opposite end. The spring 64 acts on this opposite end to get the grip to clamp cable 10. The grips 54, 56 associated with cable 12 are symmetrically placed on each side of the transverse axis Y—Y of the carriage 48, while the grips 50, 52, also symmetrical, enclose the grips 54, 56. The imaginary coupling points of the grips 54, 56 and 50, 52 on the cables 10, 12 are thus situated on the axis Y—Y, which prevents dissymmetry in the driving of carriage 48. The working of the grips is obvious, and the reader can refer to said patent application for more details. Inside the terminals, the wheels 68 roll on two parallel rails 26, one of them being suppressed in the curves in order to facilitate shunting. Carriage 48 is fitted with two friction plates 70 able to work together with the drive wheels 72 in the terminals. This driving is perfectly symmetrical.

The suspension bar 46 hangs straight in the symmetry plane of the cables 10, 12, and the only authorized motion with respect to carriage 48 is pivoting on the axle 58, which results in an oscillating movement in said symmetry plane. It is easy to understand that the suspension bar 46 remains at all times perpendicular to axle 58, i.e. to the level line of both cables 10 and 12. As the cables 10, 12 are obligatorily on the same level when passing the balancing units 34, 36, the suspension bar 46 hangs vertically and the stability of the gondolas 24 on passing the towers is remarkable. The restoring torque applied on the gondolas 24 when entering the balancing units 34, 36 is proportional to the clearance between the cables 10 and 12, and there is much to be gained by laying the cables 10, 12 apart from each other as much as possible. Moreover, a large clearance allows for the laying-out of the carriage 48 between the cables 10, 12, and also for the deviation of the cables 10, 12 inside the terminals 14 by means of vertical axle rollers, in the manner described hereunder. Inversely, the support structures, namely the stirrups 32, 44, grow rapidly too huge, and a clearance of 75 cm is finally a good compromise. Suspension by two thick cables 10, 12 grants improved safety, and the gondolas 24 can thus be relatively large and accomodate several dozens of passengers.

The cables 10, 12 form two endless loops between the drive terminals 14 and the cable tightening terminals 15. The drive pulleys 16, 17 of terminal 14 are coaxial and superposed, the clearance between them being very small. Each of the pulleys 16, 17 can advantageously be fitted with a braking track 71, 73 in prolongation of its inner flange, whose inertia is lower than that of the pulley itself. A braking clamp 74 encloses both tracks 71, 73 in such a manner that one of the brake shoes 76 engages the free face of one of the tracks, while the other shoe 78 engages the free face of the other track. The brake device is for instance of a hydraulic type and forces the shoes 76, 78 nearer to each other, applying them on the tracks 71, 73 with an equal force since the clamp 74 is of the floating type. When braking, the tracks 71, 73 are forced against each other, which interlocks the sheaves 16, 17.

The axles 20, 21 of the pulleys 16, 17 are connected through the transmissions 80, 82 to the planetary gears 84, 86 of a differential 88 whose pinions 90 are driven by a motor 92. This differential may be hydraulic or electric, the result having to be an equal pull on both cables 10, 12 and its permanent readjustment.

Figure 15:
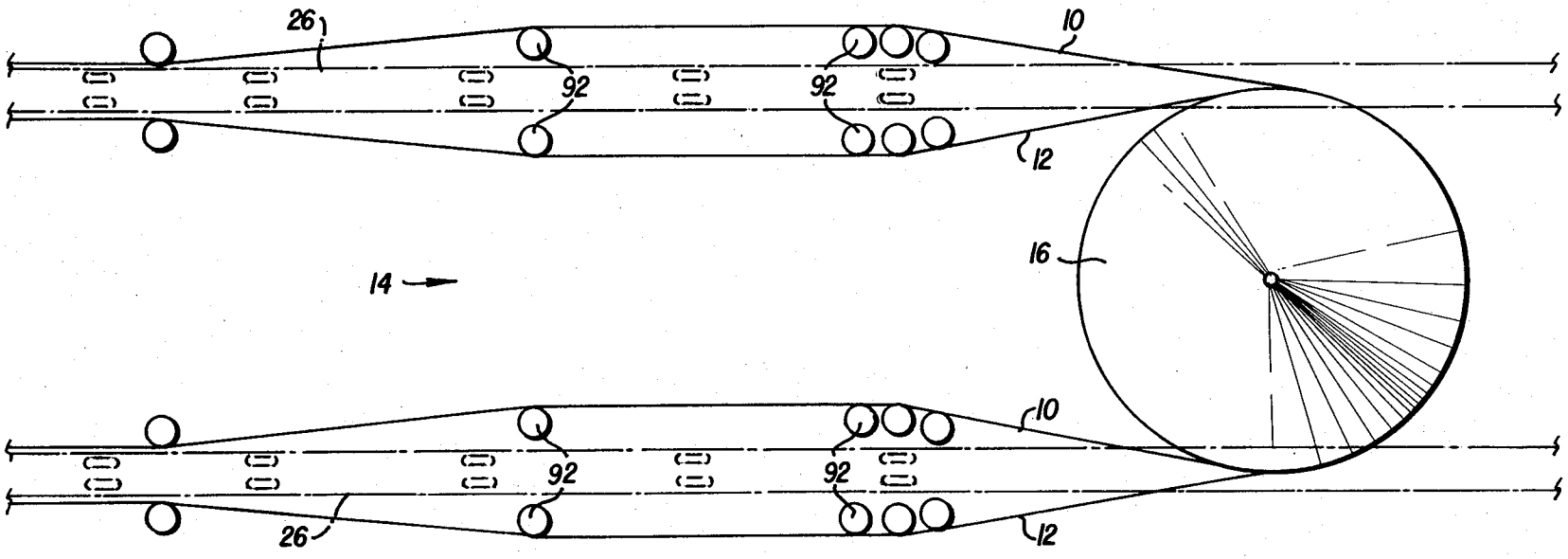
FIG. 15 is a schematic top view of the drive terminal.
Figure 16:
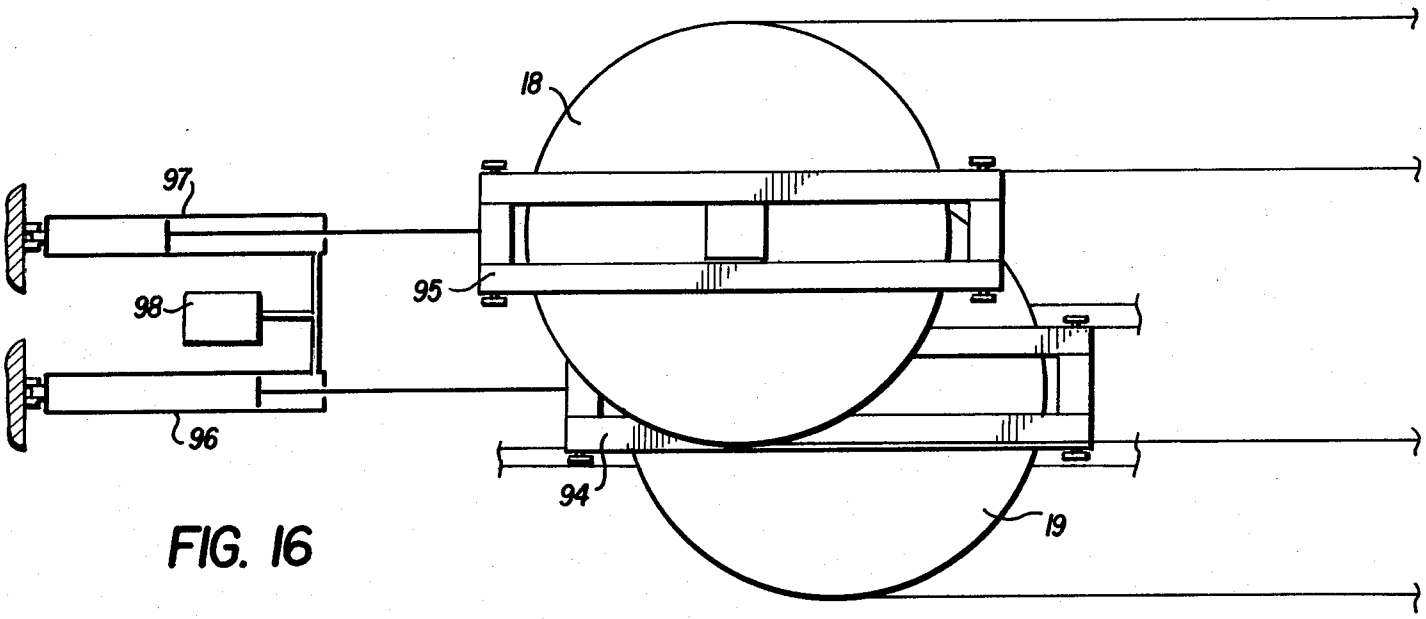
FIGS. 16 and 17 are respectively a top and a front view of the cable tightening mechanism.
Figure 17:
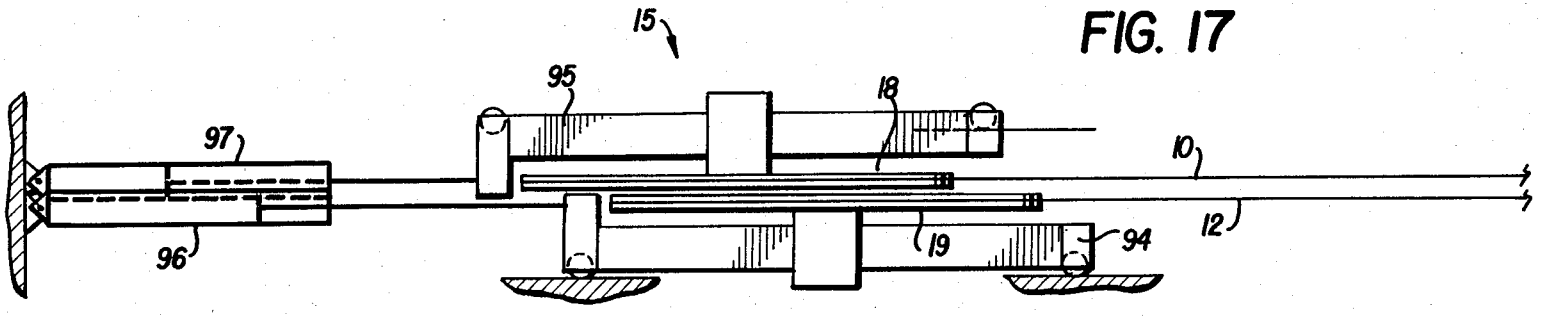

Referring more particularly to FIG. 15, it can be seen that the cables 10, 12 pass over guide rollers 92 before and after the pulleys 16, 17, in order to separate the two cables of each line, the clearance between the cables being slightly increased over certain stretches before and after the pulleys, for reasons given below. The cables 10, 12 run symmetrically, as cable 10, which is on the inside of the line before the pulley, passes to the outside of the line after the pulley, and inversely. That way, both loops run over the same number of guide rollers 92 and are submitted to the same amount of braking or resistance to motion.

Figure 18:
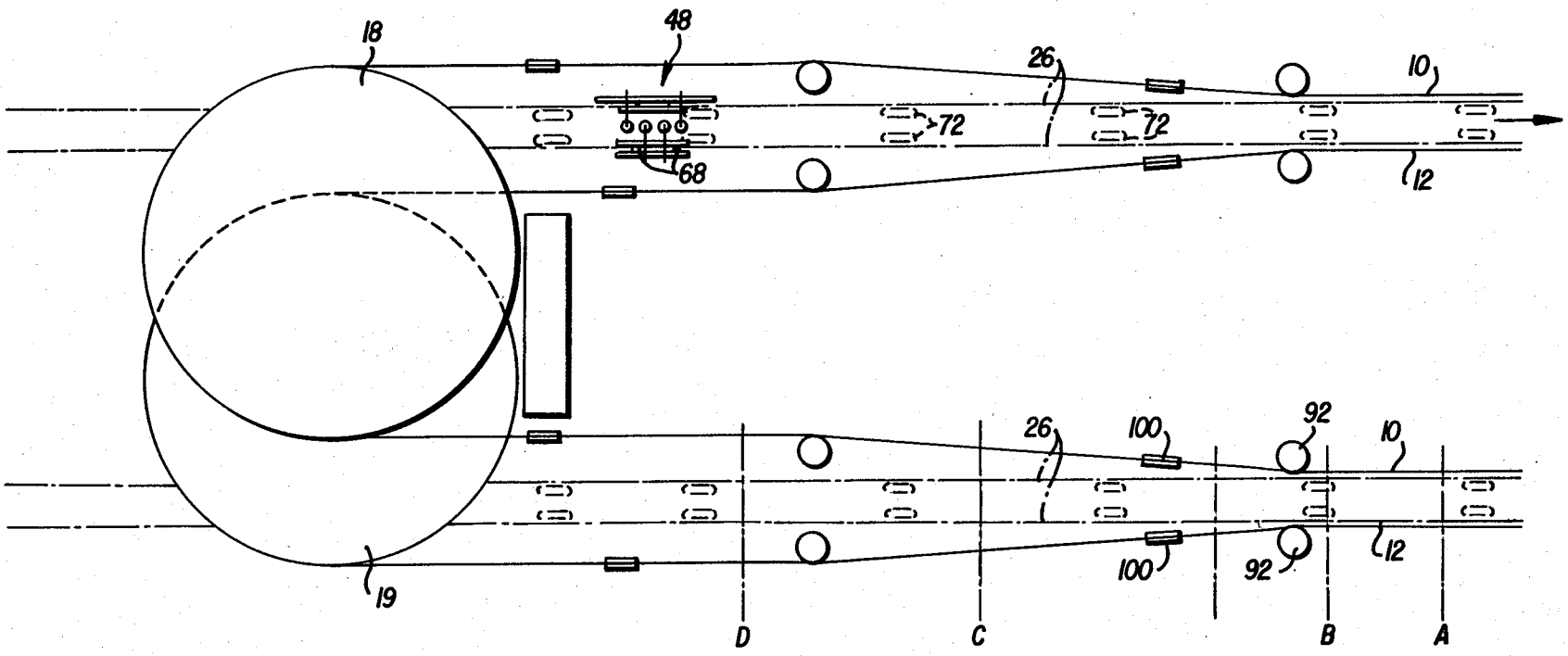
FIGS. 18 and 19 are respectively schematic top and front views of the cable tightening terminal.
Figure 19:
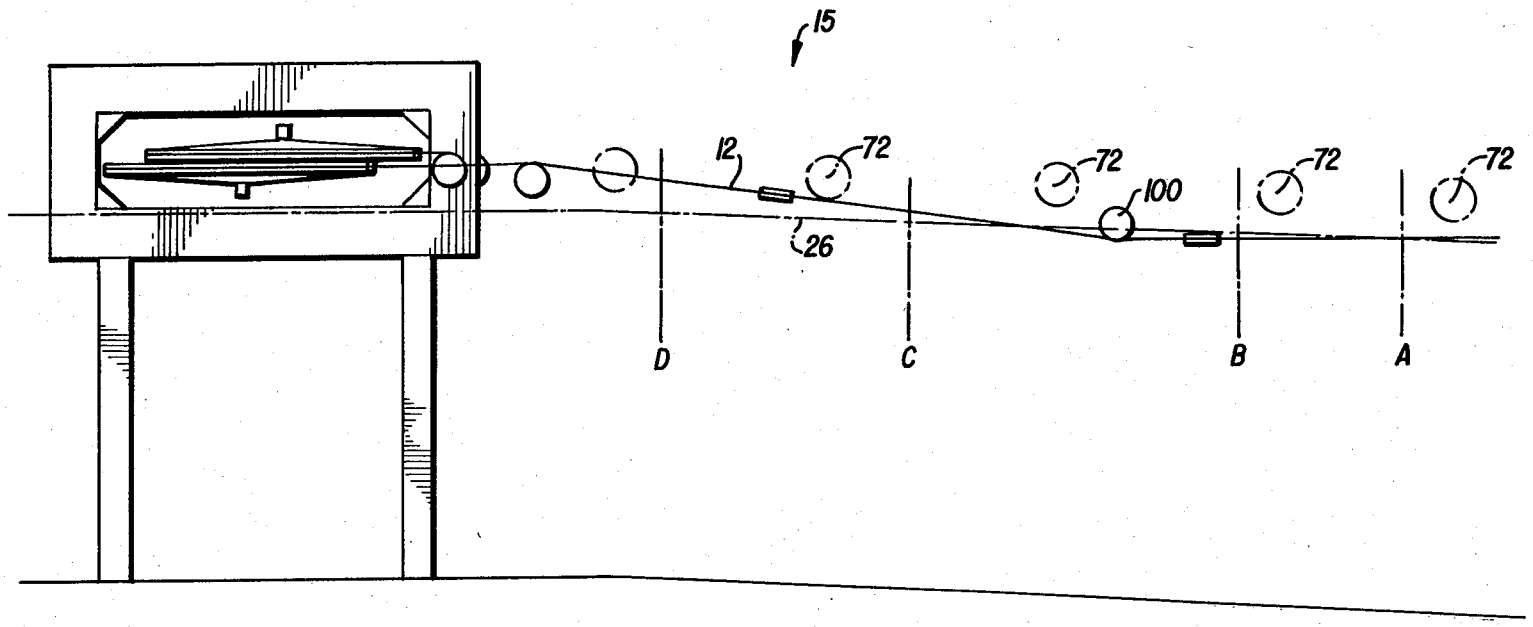

With particular reference to FIGS. 16 to 19, it can be seen that the cables 10, 12 run, inside the cable tightening terminal 15, over loose pulleys 18, 19, which are identical but laterally staggered by a distance equal to the clearance between the cables. The pulleys 18, 19 are mounted on slides 94, 95 moving in the general direction of the line and actionned by the jacks 96, 97 in the cable tightening direction. The jacks 96, 97 are strictly identical, and driven by the same pressure source 98, so as to apply an equal pull on the cables 10, 12 while absorbing slight length differences of the cable loops 10, 12. The jacks 96, 97 form a compensation device, that may also be of a mechanical type. The jacks 96, 97 may be replaced by two counterweights or by any similar device. The in-line operation of the gondola lift goes without comments, and only the passage through station 15 is described below with reference to FIGS. 18 to 23, the passage through station 14 being identical. Assuming that the cables 10, 12 run in phase in the direction indicated by the arrow on FIGS. 18, 19, the lower line on FIG. 18 is the going-in line, i.e. the disconnection and disengagement line of the gondolas 24 from the cables 10, 12, and the upper line is the going-out line, for engagement and re-connection of the gondolas to the cables 10, 12.

Figure 20:
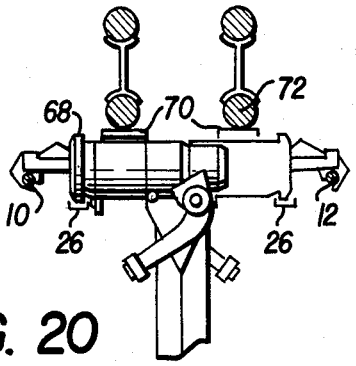
FIGS. 20 to 23 show the carriage equipped with grips of another type, in the same different positions as on FIG. 18.
Figure 21:
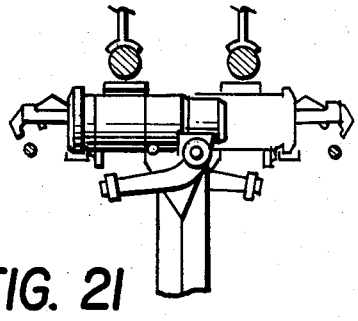
Figure 22:
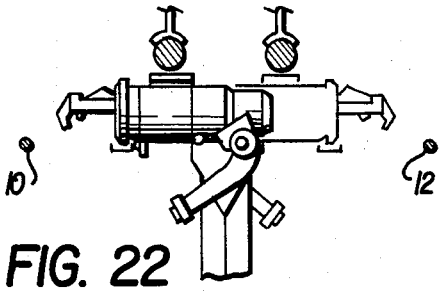
Figure 23:
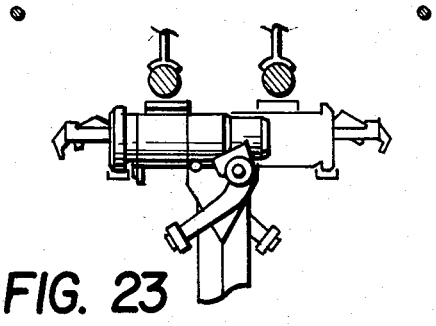

When the gondolas 24 enter terminal 15, the wheels 68 of the carriage 48 roll on the rails 26 represented by chain-dotted lines, and the levers 66 trigger the opening of all the grips 50 to 56 in the usual manner (position A, FIG. 20). Thereafter, the rails 26 deviate the carriage 48 slightly upwards with respect to the cables 10, 12, so as to disengage the grips 50 to 56 from the cables 10, 12 (position B, FIG. 21). Below position B in the motion direction of the cables 10, 12, the latter pass over vertical axle guide rollers 92 that lead them apart from each other so that the clearance between them grows larger than the total width of carriage 48, the jaws 60, 62 being in opened position. In this area, the trajectory of the rails 26 bends downwards with respect to the cables 10, 12, which run under horizontal axle guide rollers 100 so as to disengage the carriage 48 downwards (position D, FIG. 22 and position C, FIG. 23), the carriage 48 passing under the end pulleys 18, 19. The slowing down of the gondola 24 can be triggered as soon as the grips 50 to 56 open. The exit of terminal 15 is laid-out symmetrically and provides for the connection of the gondolas 24 to the cables according to a reversed sequence: passage of the carriage 48 under the pulleys 18, 19, engagement of the carriage between the cables 10, 12, bringing the cables nearer to one another, engagement of the jaws over the cables with synchronization of the carriage's speed with that of the cables, and closing of the grips. Symmetry is maintained between the two cable loops 10, 12.

The gondolas 24 disconnected from the cables travel inside the terminal over transfer and parking tracks of the usual type, allowing for embarkation and disembarkation of the passengers at null or reduced speed. On leaving the terminal, the gondolas are re-connected to the cables 10, 12 in this manner. The lay-out of the other terminal 14 is indentical and requires no description. It is worth observing that all these operations can be easily automatized as in the conventional gondola lifts, that they are carried out without stopping the gondola and that they only require standard devices whose efficiency and reliability have been proven.

The high capacity of the gondolas allows for a limitation of their number in service at the same time, while maintaining a high passenger flow rate, and it is possible to park the gondolas 24 on the transfer rails 26 of the terminals while ensuring departure on request. This prevents idle operation and useless wear.

Figure 24:
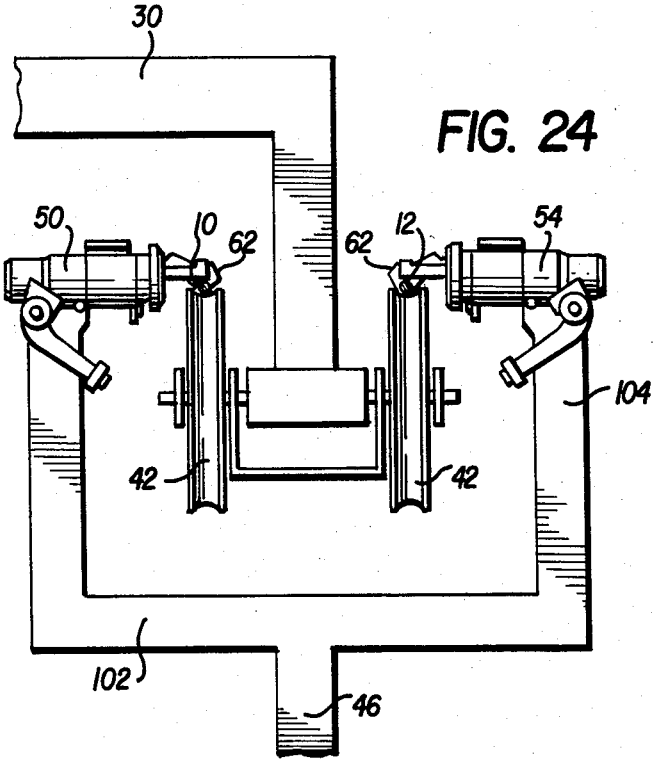
FIG. 24 shows a realization alternative of the carriage and of the balancing unit support.

FIG. 24 shows a realization alternative of the invention in which the suspension bar 46 of the gondolas 24 is articulated on a carriage 102 whose U-shaped frame 104 encloses both cables 10, 12. The grips 50–56 of the frame 104 are turned inwards to the cables 10, 12 clamped in the jaws 62 placed in front of each other. The towers are shaped accordingly, to provide for free passage of the carriage 102, by mounting the support roller balancing units 42 at both ends of a cross bar 106 extending transversely between the cables 10, 12. This reversed arrangement does not modify the operation of the installation, but requires a certain squeezing of the cables inside the terminals for the engagement or disengagement of the carriage 102. The lay-out of the carriage 102 is more elaborate and more cumbersome, but that of the towers is on the other hand simpler.

The invention can obviously be applied to installations with a different number of grips, or with grips of a different type.

Figure 25:
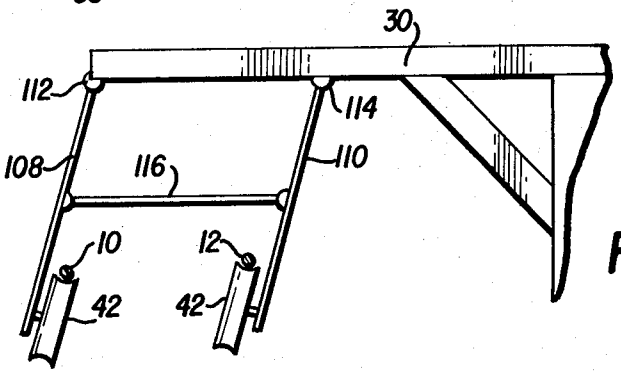
FIG. 25 is similar to FIG. 13 and shows a realization alternative with inclinable balancing units.
Figure 14:
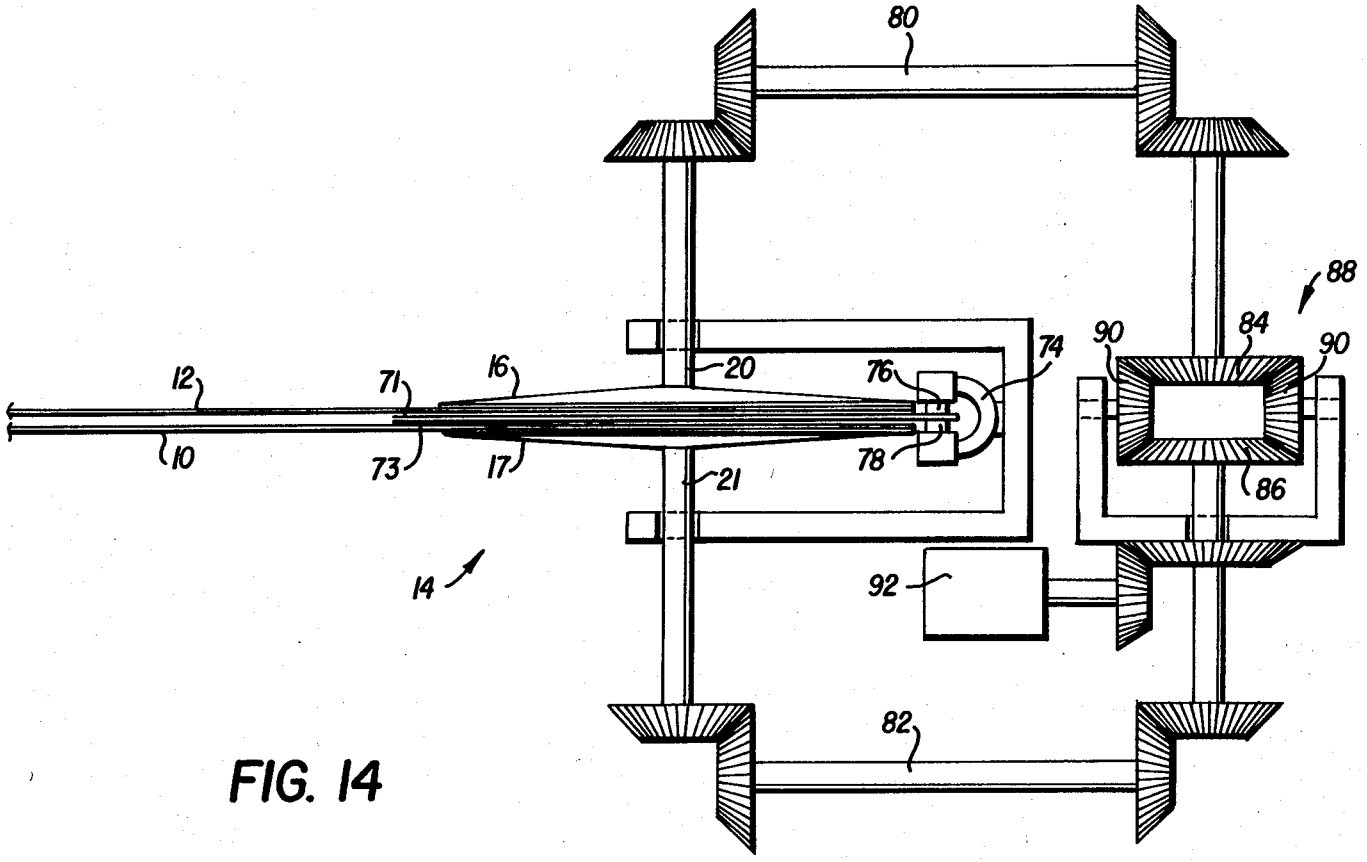
FIG. 14 is a front view of the drive mechanism of the two cables.

FIG. 25 shows a preferred lay-out of the support balancing units of the cables 10, 12. Each support roller balancing unit 42 is kept up by the end of an arm 108, 110 articulated in 112, 114 on the cross bar 30 to allow for displacement in a transverse plane with respect to cables 10, 12. A connecting bar 116 links the arms 108, 110 together so as to form a deformable quadrilateral which maintains the rollers 42 parallel to each other at any time, at a constant distance whatever the displacement of the arms 108, 110.

Figure 26:
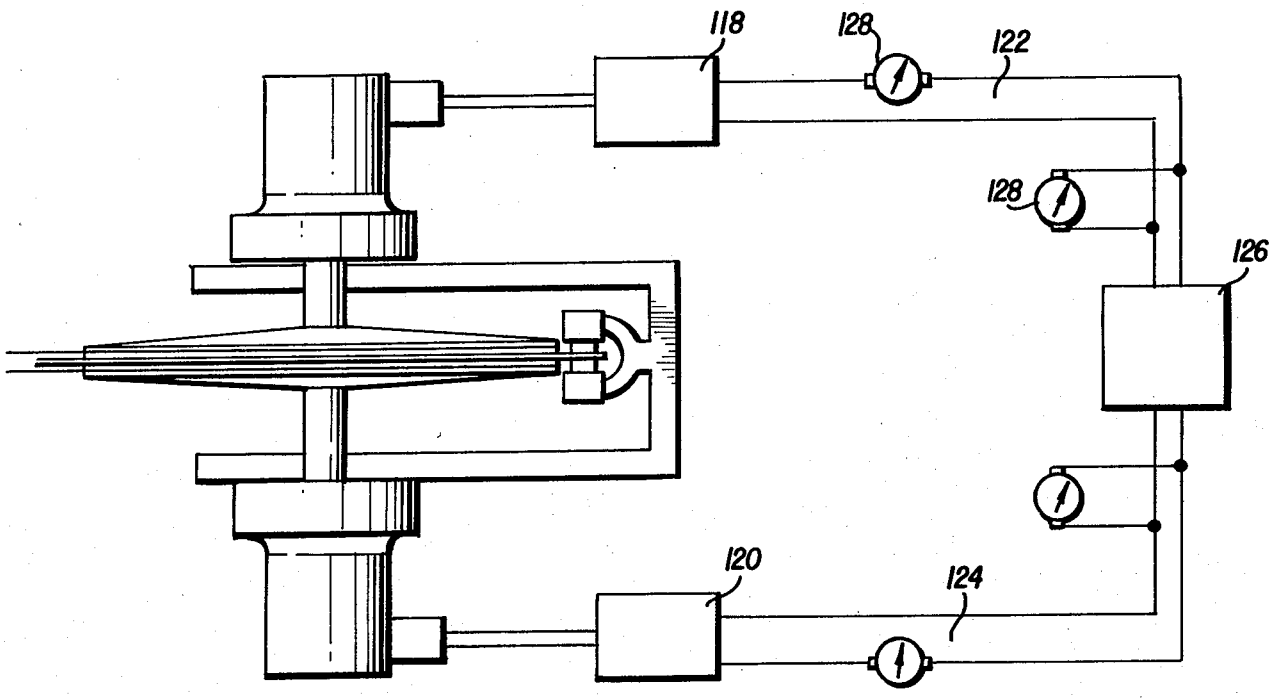
FIG. 26 is similar to FIG. 14 and shows a drive mechanism with electric differential device.

The drive mechanism of the pulleys 16, 17 may comprise an electric differential such as schematically represented on FIG. 26. Each pulley 16, 17 is driven by an electric motor 118, 120, both motors being perfectly identical. They are connected through the supply lines 122, 124 to a single electric power supply source 126. Measuring instruments 128 integrated into the lines 122, 124 report permanently on the intensity and voltage of the current supplied to each motor 118, 120. Both circuits being symmetrical, the outputs of the motors are identical and the intensities and voltages are the same. Of course there always remains a slight difference between the intensities and/or voltages, but it can be detected or offset. In normal operation, both cables are driven at the same speed and the measurement difference remains constant. Any incident, for instance an increase of the resistance to motion in one of the cables, will be automatically signalled, and, depending on the amplitude of the variation, the defect will either be merely reported, or will cause the installation to stop.

Figure 27:
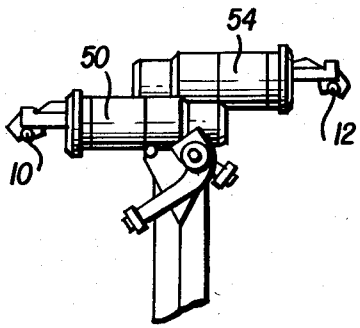
FIG. 27 shows a further alternative.

FIG. 27 shows a realization alternative in which both grips 50, 54 and 52, 56 respectively are superposed, the cables 10, 12 being slightly staggered in height. This staggering may correspond to that of the end pulleys in the terminals.

What I claim is:

1. An overhead transport installation comprising:

terminals having each two pulleys two parallel suspension haulage cables passing over said pulleys and being continuously driven at the same speed while extending in line in a horizontal plane with constant spacing, towers including cable support rollers for supporting said two cables at a same level, gondolas coupled in line to said two cables and each having a suspension bar hanging in the vertical symmetry plane of the cables and a carriage whereon said suspension bar is articulated, at least one pair of detachable grips secured to said carriage, one grip cooperating with one cable and the other grip of said pair cooperating with the other of said two cables for coupling the carriage to the two cables in line and to disconnect the carriage inside the terminals to allow for embarkation and disembarkation of the passengers of the gondola at a reduced speed, each grip having a body that rests on the upper face of the cable in closed position of the grip and protrudes slightly upwards and a pair of jaws protruding downwards from said body to surround and clamp the cable while the end of the jaws become substantially level with the lower face of the cable in order to facilitate passing around the cable support rollers, cable guide rollers disposed in the terminals in order to deviate said cables so as to modify slightly the spacing to each other and to allow for disengagement or engagement of the carriage disconnected from the cables, and transfer rails in the terminals for supporting the carriage disconnected from the cables, the trajectory of the rails bending downwards with respect to the cables on the travel section corresponding to the modified spacing of the cables for disengagement of the carriage and bending upwards in the travel section for engagement of the carriage.

2. The installation according to claim 1, wherein every carriage has two pairs of grips forming in connected position a rigid quadrilateral linking both cables together and forcing a synchronous displacement of the cables.

3. The installation according to claim 2, wherein said grips overlap one another, both grips connected to a single cable being symmetrically placed on both sides of the transverse symmetry axis of the carriage passing by the resultant coupling points to the cables.

4. The installation according to claim 1, wherein said slight upward protruding of the grip body is symmetrical, in order to prevent any dissymmetry when the grips pass under pressure rollers.

5. The installation according to claim 1, wherein said two cables form two endless loops offering a perfect symmetry of friction, tension, driving, and consequently of trajectory and speed.

6. The installation according to claim 5, further comprising a drive terminal having two driving pulleys, each cable running over one of said driving pulleys, and a differential device for linking said two driving pulleys to permanently balance the pull and the displacement speed of both cables.

7. The installation according to claim 6, wherein said differential comprises two identical electric motors, an electric power supply source delivering current to said motors, each of the motors driving one of the cables, and measuring instruments intended for detecting any diffference in the current supply to both motors, caused by an incident on one of the cables.

8. The installation according to claim 6, wherein both driving pulleys are superposed with a very small clearance between them in order to achieve free relative rotation, and further comprising a braking device for interlocking both pulleys when actionned.

9. The installation according to claim 5, further comprising a tightening terminal having two loose end pulleys, each of the cables running over a loose guide pulley and a compensation device cooperating with said two loose pulleys in such a manner that the tension is the same at any time in the four lines taken two by two.

10. The installation according to claim 1, wherein every tower comprises two symmetrical balancing units, each of them being associated with one of said cables, and linking means for mechanically linking paired elements of both balancing units in order to ensure their symmetrical pivoting, as well as a constant spacing corresponding to that of the carriage grips.

11. The installation according to claim 10, wherein said grips protrude laterally on both sides of the carriage engaged between the two cables, said cables being kept up in line by balancing unit supported by reversed U-shaped stirrup pieces fixed on the towers, and being separated from each other inside the terminals to a spacing allowing for downwards disengagement of the carriage previously disconnected from the cables.

12. The installation according to claim 1, wherein every tower comprises two symmetrical balancing units, each of them being associated with one of said cables and fixed on one of the sides of an articulated parallelogram allowing for symmetrical cross displacement with respect to the longitudinal direction of the cables.

13. The installation according to claim 1, further comprising balancing units fixed on the ends of a cross bar attached to a tower for supporting both cables, the grips of the carriage enclosing both cables.

14. The installation according to claim 1, wherein the grips connected to one of the cables are superposed on the grips connected to the other cable, both cables being slightly staggered in height.

* * * * *